US005434582A

United States Patent [19]

Koike et al.

[11] Patent Number: 5,434,582

[45] Date of Patent: Jul. 18, 1995

[54] EXTENDABLE ANTENNA AND RADIO TRANSCEIVER USING THE SAME

[75] Inventors: Noboru Koike, Tama; Hirokazu Seraku, Hino, both of Japan

[73] Assignee: Kabushiki Kaisha Toshiba, Kawasaki, Japan

[21] Appl. No.: 87,337

[22] Filed: Jul. 8, 1993

[30] Foreign Application Priority Data

Jul. 9, 1992 [JP] Japan ..... 4-048028 U

[51] Int. Cl.[6] ..... H01Q 1/10

[52] U.S. Cl. ..... 343/702; 343/752; 343/848

[58] Field of Search ..... 343/892, 702, 900, 901, 343/749, 752; H01Q 1/10

[56] References Cited

U.S. PATENT DOCUMENTS

| | | | |
|---|---|---|---|
| 4,525,718 | 6/1985 | Imazeki et al. | 343/702 |
| 4,660,049 | 4/1987 | Shinkawa | 343/901 X |
| 4,958,382 | 9/1990 | Imanishi | 343/702 X |
| 5,177,492 | 1/1993 | Tomura et al. | 343/900 X |
| 5,204,687 | 4/1993 | Elliott et al. | 343/702 |

FOREIGN PATENT DOCUMENTS

| | | | |
|---|---|---|---|
| 4336803 | 11/1992 | Japan | H01Q 1/24 |

*Primary Examiner*—Donald Hajec
*Assistant Examiner*—Tho G. Phan
*Attorney, Agent, or Firm*—Finnegan, Henderson Farabow, Garrett & Dunner

[57] ABSTRACT

An extendable antenna which has a cylindrical antenna guide for slidably retracting a first antenna portion of the extendable antenna into the interior of a housing of a radio transceiver in which the antenna guide is provided at its one end with a cylindrical grounding connection member connected to a grounded portion of the radio transceiver and to be brought into contact with a first contact portion of the antenna when the first antenna portion is retracted into the interior of the housing. The grounding connection member is disposed to contact with the housing so as to face a water drain hole provided in the housing, whereby, when the first antenna portion with rain water attached thereto is retracted into the interior of the housing, the rain water introduced into the antenna guide is guided through the interior of the cylindrical grounding connection member and discharged through the water drain hole of the housing to the outside of the radio transceiver. As a result, intrusion of the rain water into the communication circuit disposed within the housing can be prevented. Further, since the first contact portion is brought into contact with the grounding connection member when the first antenna portion is retracted into the interior of the housing, the communication function of the antenna is not deteriorated.

17 Claims, 7 Drawing Sheets

EXTENDABLE ANTENNA AND RADIO TRANSCEIVER USING THE SAME

BACKGROUND OF THE INVENTION

1. Field of the Invention

The present invention relates to an extendable antenna and a radio transceiver using the extendable antenna which comprises a first antenna portion and a second antenna portion provided at an end of the first antenna portion, a cylindrical antenna guide provided inside of a housing of the transceiver slidably retracting the first antenna portion, and a bottom hole for discharging water introduced into the antenna guide.

2. Description of the Related Art

FIGS. 10(*a*) and 10(*b*) show a prior art portable radio transceiver A having a circuit board C including a communication circuit (not shown) disposed within a housing B of the radio transceiver and, an extendable antenna D disposed in the housing B and extended along the circuit board C in the housing B.

The extendable antenna D includes an antenna member E which has a rod antenna portion Ea having a length of wavelength $\lambda/4$, for example, and a helical antenna portion Eb provided with a conductive portion having a length of wavelength $\lambda/4$ or $\lambda/2$ and connected to the tip end of the rod antenna portion Ea. The rod antenna portion Ea is provided at its base end (right end in the drawing) with a first contact portion Ec, while the helical antenna portion Eb is provided at its base end (right end in the drawing) with a second contact portion Ed.

Meanwhile, a cylindrical antenna guide F is disposed along the circuit board C in the interior of the housing B, and the rod antenna portion Ea of the antenna member E is slidably retracted into the antenna guide F formed by an insulating tube of smooth material such as Teflon (Trade Name of E. I. du Pont de Nemours & Co., Inc., U.S.A.).

That is, the antenna member E is mounted to be slidable to the housing B, so that, when the antenna member E is slid into the interior of the housing B, the rod antenna portion Ea is retracted within the housing B.

As shown in FIG. 10(*b*), when the rod antenna portion Ea of the antenna member E is extended from the housing B, the first contact portion Ec of the antenna member E fits in a power supply connection member G provided in the housing B.

As a result, electromagnetic waves received at the rod antenna portion Ea and helical antenna portion Eb are sent from the power supply connection member G through a contact terminal H contacted with the power supply connection member G to a receiver portion in the communication circuit of the circuit board C; whereas, a signal emitted from a transmitter portion of the communication circuit is sent to the rod antenna portion Ea and helical antenna portion Eb and transmitted therefrom.

When the rod antenna portion Ea of the antenna member E is retracted into the interior of the housing B so that only the helical antenna portion Eb is exposed to the outside of the housing B as shown in FIG. 10(*a*), on the other hand, the second contact portion Ed of the antenna member E fits in the power supply connection member G, whereby only the helical antenna portion Eb functions as the antenna.

Under such a condition as mentioned above, the first contact portion Ec of the antenna member E comes into contact with a contact terminal I which is grounded. Thus, the rod antenna portion Ea of the antenna member E does not function as the antenna.

With the radio transceiver A having the aforementioned arrangement, in the event where rain water is attached to the rod antenna portion Ea extended from the housing B as shown in FIG. 10(*b*), if the rod antenna portion Ea is retracted into the housing B without removing the rain water, there may occur a danger that the rain water is introduced from the rod antenna portion Ea along the antenna guide F into the housing B, which may undesirably result in that the communication circuit is disabled or broken when the rain water further intrudes into the communication circuit.

In order to beforehand prevent the intrusion of the rain water attached to the antenna member E into the interior of the housing B, it is considered to extend one end (right end in the drawing) of the antenna guide F up to a water drain hole Ba provided in the housing B. With this arrangement, however, when the rod antenna portion Ea of the antenna member E is retracted into the housing B, the first contact portion Ec of the antenna member E cannot be electrically connected to the contact terminal I. As a result, the rod antenna portion Ea of the antenna member E cannot be grounded and thus the function of the antenna member E may be deteriorated.

SUMMARY OF THE INVENTION

As has been explained above, the prior art radio transceiver has had such a disadvantage that, when the rod antenna portion with rain water attached thereto is retracted into the housing, the rain water intrudes into the interior of the housing and causes the communication function disabled. Further, for the purpose of preventing the intrusion of the rain water into the housing, when one end of the antenna guide is extended up to the water drain hole of the housing, the rod antenna portion cannot be brought into contact with the grounded portion whereby the function of the antenna is unfavorably deteriorated.

In view of the above circumstances, it is an object of the present invention to provide an extendable antenna and a radio transceiver using the extendable antenna which, even when the antenna attached with rain water is retracted in a housing of the radio transceiver, can avoid deterioration of its function and also can beforehand prevent intrusion of the rain water into a communication circuit located within the housing.

In accordance with the invention, there is provided an extendable antenna for a radio transceiver enclosed in a housing, which comprises: a first antenna portion having a first conductive connection portion; a second antenna portion connected with the first antenna portion at an end of the first antenna portion; a cylindrical antenna guide member provided within the housing for retracting the first antenna portion; and a cylindrical grounding connection member provided at an end of the antenna guide member and connected to a grounded portion of the radio transceiver, the grounding connection member facing a water drain hole provided in the housing, in which, when the first antenna portion is retracted into the housing, the first conductive connection portion is brought into contact with the grounding connection member.

In the present invention, even when the first antenna portion with rain water attached thereto is retracted into the interior of the housing of the radio transceiver, the rain water attached to the first antenna portion and thus introduced into the antenna guide member is led through the interior of the cylindrical grounding connection member and discharged through the water drain hole of the housing to the outside of the radio transceiver. As a result, the intrusion of the rain water into a communication circuit disposed within the housing can be prevented. Further, since it is arranged that, when the first antenna portion is retracted into the housing, the first conductive connection portion is brought into contact with the grounding connection member connected to the grounded portion of the radio transceiver, the function of the second antenna portion can be secured.

DESCRIPTION OF THE PREFERRED EMBODIMENTS

The present invention will be detailed with reference to the accompanying drawings showing embodiments of the invention.

Figure 1A:
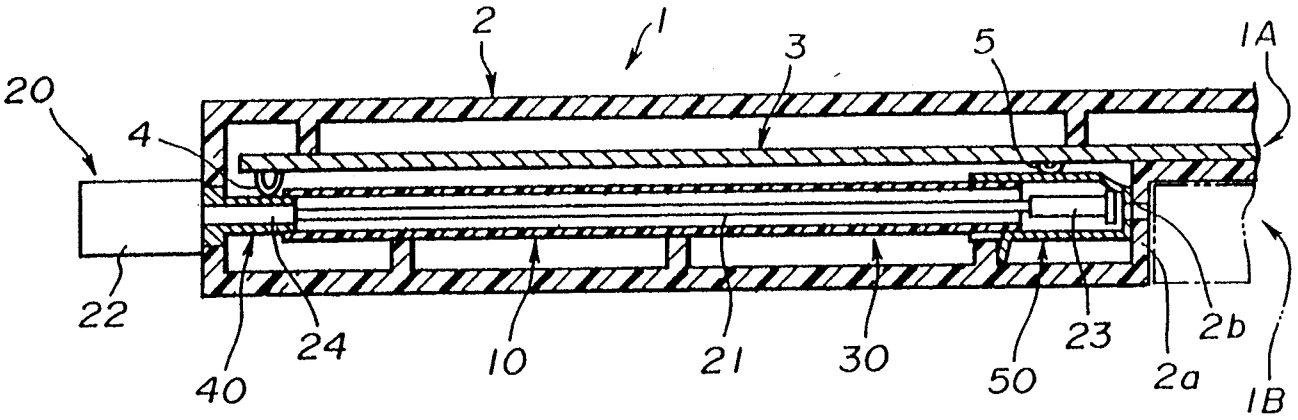
FIGS. 1(*a*) and 1(*b*) show side cross-sectional views of major parts of an extendable antenna and a radio transceiver in accordance with the present invention.
Figure 1B:
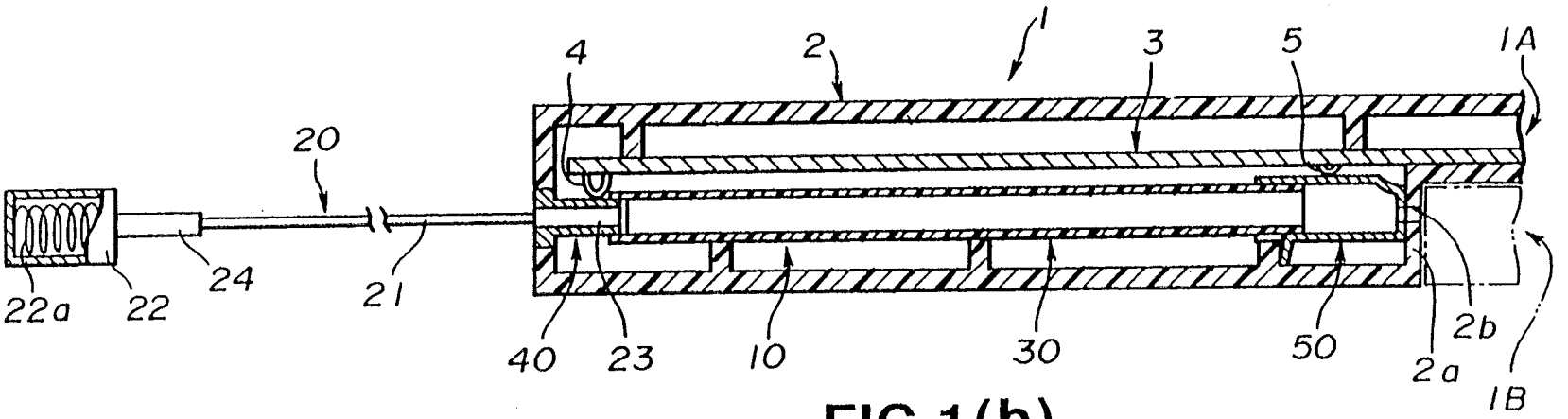
Figure 2:
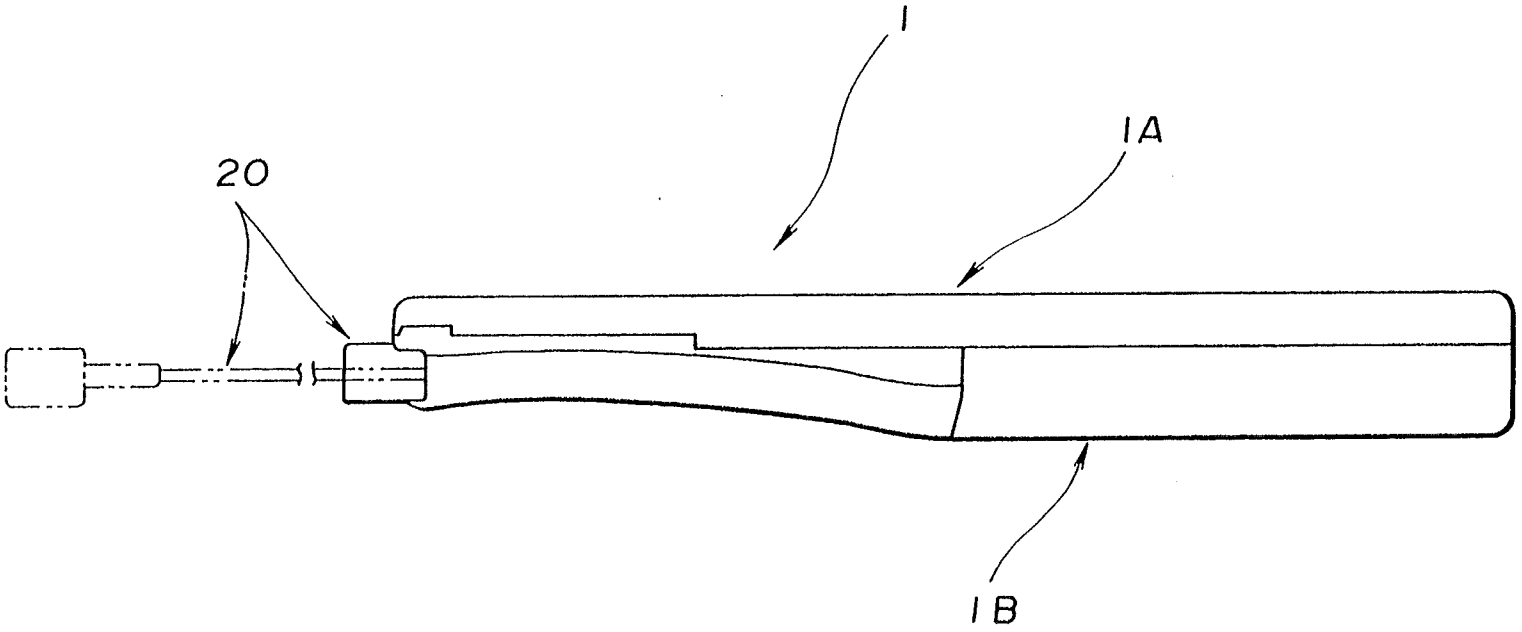
FIG. 2 is a side view showing the entire appearance of the radio transceiver.

FIGS. 1 to 4 show a portable radio transceiver (mobile telephone set) which employs an extendable antenna in accordance with an embodiment of the present invention. More specifically, as shown in FIG. 2, a radio transceiver 1 comprises a main body 1A having a transmitter/receiver portion (not shown) provided thereto and a battery pack 1B mounted at the back of the main body 1A.

As shown in FIG. 1, in the interior of a housing 2 of the main body 1A, a circuit board 3 having a communication circuit (not shown) mounted thereon is disposed. An extendable antenna 10 enclosed in the housing 2 is disposed to extend parallel to and along the circuit board 3.

The extendable antenna 10 is disposed at projected portions of the main body 1A at its back side continuous to the battery pack 1B. As shown in FIGS. 1 and 2, the housing 2 of the main body 1A is provided with a water drain hole 2*b* in its wall plate 2*a* opposing the battery pack 1B.

As shown in FIG. 1, the extendable antenna 10 includes an antenna member 20 which in turn has a rod antenna portion 21 as a first antenna portion and a helical antenna portion 22 as a second antenna portion provided at the tip end of the rod antenna portion 21. Further, a first contact portion 23 is provided to a base end (right end in the drawing) of the rod antenna portion 21, while a second contact portion 24 is provided to a base end (right end in the drawing) of the helical antenna portion 22.

The rod antenna portion 21 is formed by applying an insulating film onto a rod-shaped conductor (such as a piano wire) having a length of λ(wavelength)/4. Meanwhile, the helical antenna portion 2 includes a helically-wound conductor (loading coil) 22*a* having a length of λ/4. The conductor of the rod antenna portion 21 is electrically connected in series with the conductor 22*a* of the helical antenna portion 22 through the second contact portion 24. The helical antenna portion 22 has substantially the same antenna function as the rod antenna portion 21 having the length of λ(wavelength)/4.

It should be noted that the length of the rod-shaped conductor and the length of the helically-wound conductor are not limited to the above-mentioned length of λ(wavelength)/4.

A cylindrical antenna guide 30 in the form of an insulating tube of smooth material such as Teflon (Trade Name of E. I. du Pont de Nemours & Co., Inc., U.S.A.) is provided in the interior of the housing 2 in parallel to the circuit board 3 and, the rod antenna portion 21 of the antenna member 20 is slidably retracted in the interior of the antenna guide 30.

That is, the antenna member 20 is mounted slidably to the housing 2 so that, when the antenna member 20 is slid toward the interior of the housing 2, the rod antenna portion 21 is retracted within the housing 2.

The antenna guide 30 is provided at its one end (left-end in FIG. 1) with a power supply connection member 40 and at the other end (right-end in FIG. 1) with a grounding connection member 50. The antenna member 20 is installed so that the rod antenna portion 21 can be slidably moved within the power supply connection member 40 and the first contact portion 23 can be slidably moved within the grounding connection member 50.

The power supply connection member 40, which is a cylindrical member fixedly provided to the housing 2, is fittingly received in one end of the antenna guide 30. The power supply connection member 40 loosely receives the rod antenna 21 and selectively fittingly receives the first or second contact portion 23 or 24.

More in detail, the power supply connection member 40 is provided therein with a slit (not shown) which is opened when the member fittingly receives the first or second contact portion 23 or 24 and is closed when the member loosely receives the rod antenna 21. In this way, the power supply connection member 40 can tightly fittingly receive the first or second contact portion 23 or 24.

Figure 3:
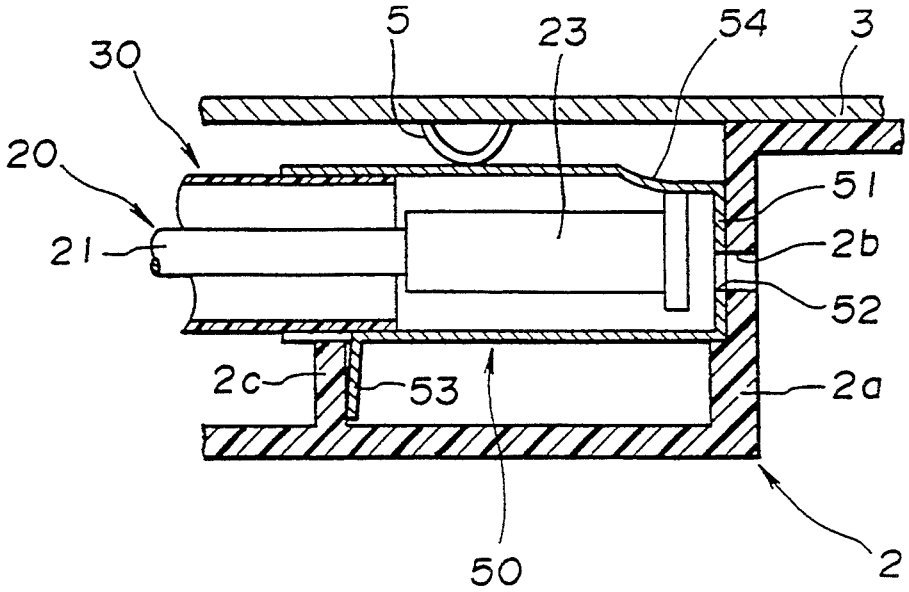
FIG. 3 is a side cross-sectional view of a major part of the radio transceiver including the extendable antenna.
Figure 4:
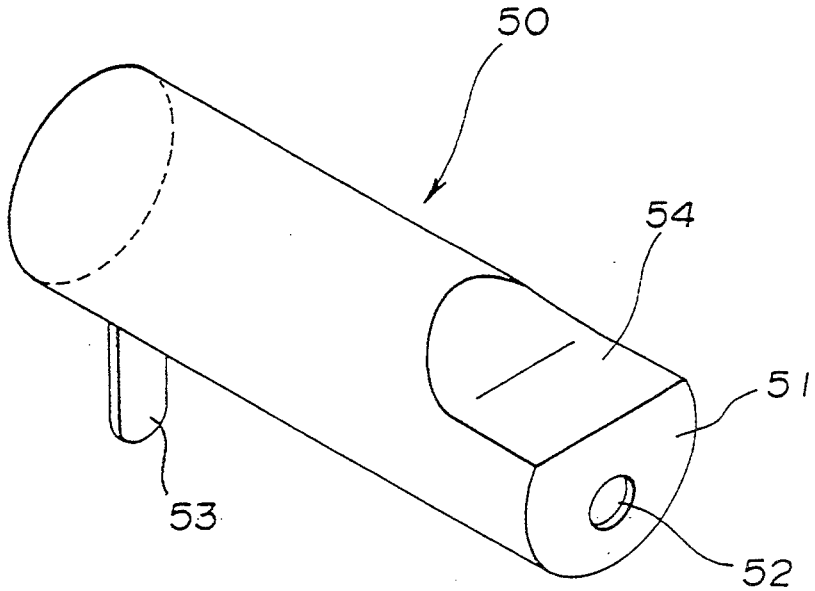
FIG. 4 is a perspective view of a grounding connection member in the extendable antenna.

Meanwhile, as shown in FIGS. 3 and 4, the grounding connection member 50, which is obtained by forming a thin sheet of an electrically conductive material into a cylinder by means of draw forming or the like, fittingly receives one end of the antenna guide 30. A bottom plate 51 of the grounding connection member 50 has a bottom hole 52 which faces the water drain hole 2*b* provided in the wall plate 2*a* of the housing 2.

Further, the grounding connection member 50 is provided with a resilient tongue piece 53. The tongue piece 53, which is contacted with a rib 2*c* of the housing 2, acts to cause the bottom plate 51 of the grounding connection member 50 to pressedly contact with the wall plate 2*a* of the housing 2. As a result, the grounding connection member 50 is firmly mounted to the housing 2 and tightly contacted with the wall plate 2*a*.

Furthermore, the grounding connection member 50 has at its one end (right-end in FIG. 3) an inwardly projected contact portion 54. The contact portion 54 is brought into press-contact with the first contact portion 23 inserted into the grounding connection member 50 under the resilient restoring force of the rod antenna portion 21, so that the grounding connection member 50 can come into positive contact with the first contact portion 23.

Meanwhile, as shown in FIG. 1, the circuit board 3 is provided with a terminal 4 which is connected to a communication circuit (not shown) and with a terminal 5 which is connected to a grounded portion (not shown) of the radio transceiver. More specifically, the terminal 4 is connected with the power supply connection member 40, while the terminal 5 is connected with the grounding connection member 50, so that the power supply connection member 40 is connected through the terminal 4 to the communication circuit (not shown) and the grounding connection member 50 is connected through the terminal 5 to the grounded portion (not shown) of the radio transceiver.

When the rod antenna portion 21 of the antenna member 20 is extended from the housing 2 as shown in FIG. 1(*b*), the first contact portion 23 of the antenna member 20 is fittedly received into the power supply connection member 40.

As a result, electromagnetic waves received at the rod antenna portion 21 and helical antenna portion 22 are sent to a receiver portion (not shown) of the communication circuit through the power supply connection member 40 and the terminal 4 contacted therewith; whereas, a signal issued from a transmitter portion of the communication circuit is radiated from the rod antenna portion 21 and helical antenna portion 22.

On the other hand, when the rod antenna portion 21 of the antenna member 20 is retracted within the housing 2 and only the helical antenna portion 22 is exposed outside the housing 2 as shown in FIG. 1(*a*), the second contact portion 24 of the antenna member 20 is fittedly received in the power supply connection member 40, so that only the helical antenna portion 22 functions as the antenna.

Further, when the rod antenna portion 21 is retracted within the housing 2, the first contact portion 23 of the antenna member 20 abuts against the grounding connection member 50 connected to the grounded portion of the radio transceiver, more particularly, against the contact portion 54 of the grounding connection member 50. This causes the rod antenna portion 21 of the antenna member 20 to be grounded. As a result, the rod antenna portion 21 does not function as the antenna.

Incidentally, when the rod antenna portion 21 with rain water attached thereto is retracted within the interior of the housing 2, the rain water attached to the rod antenna portion 21 is introduced into the interior of the antenna guide 30 through the rod antenna portion 21. However, since the antenna guide 30 is provided at its one end with the cylindrical grounding connection member 50 as already explained above, the introduced rain water is discharged to the outside from the bottom hole 52 provided in the bottom plate 51 of the grounding connection member 50 through the water drain hole 2*b* of the housing 2.

In other words, with the radio transceiver 1 having such an arrangement as mentioned above, even when the rod antenna portion 21 with rain water attached is retracted within the housing 2, intrusion of the rain water into the communication circuit disposed within the housing 2 is prevented, whereby a communication failure or circuit destruction possibly caused by the rain water intrusion can be beforehand avoided. In addition, when the rod antenna portion 21 is retracted into the housing 2 as mentioned above, the first contact portion 23 is brought into contact with the grounding connection member 50, whereby any hindrance of the communication function of the helical antenna portion 22 can be avoided.

Figure 5:
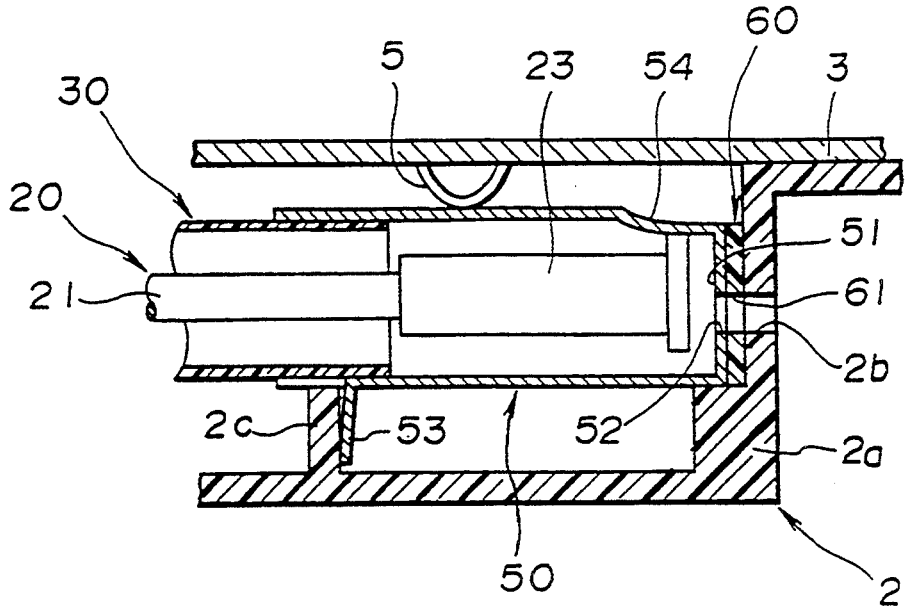
FIG. 5 is a side cross-sectional view of a major part of an extendable antenna in accordance with another embodiment of the present invention.

As a modified example, the grounding connection member 50, as shown in FIG. 5, is provided with a packing 60 which is tightly contacted with the wall plate 2*a* of the housing 2. The packing 60 is provided therein with a through hole 61 through which the bottom hole 52 provided in the bottom plate 51 of the grounding connection member 50 communicates with the water drain hole 2*b* provided in the wall plate 2*a* of the housing 2.

With the aforementioned arrangement, positive and tight contact between the bottom plate 51 of the grounding connection member 50 and the wall plate 2*a* of the housing 2 can be established by means of the packing 60 provided therebetween. As a result, in addition to the similar effect to the extendable antenna 10 shown in FIG. 1, leakage of rain water between the grounding connection member 50 and the housing 2 can be reliably avoided.

The example of FIG. 5 has substantially the same structure as the grounding connection member 50 of the extendable antenna 10 of FIG. 1, except for the packing 60 disposed between the grounding connection member 50 and the wall plate 2*a*, and thus the members having the same functions as those in FIG. 1 are denoted by the same reference numerals and detailed explanation thereof is omitted.

Figure 6:
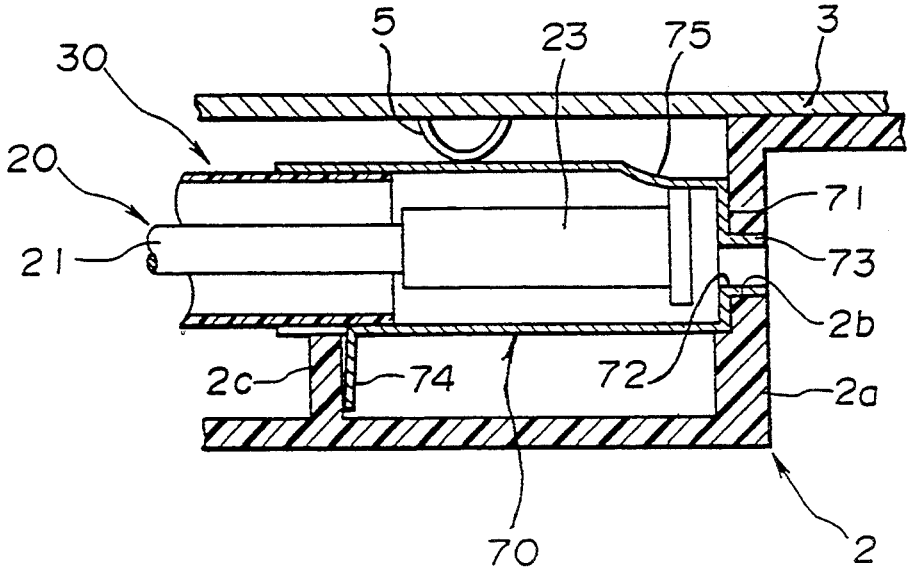
FIG. 6 is a side cross-sectional view of a major part of an extendable antenna in accordance with a further embodiment of the present invention.

As another modified example, a bottom plate 71 of a grounding connection member 70, as shown in FIG. 6, is provided with a cylindrical passage portion 73 which communicates with a bottom hole 72. More specifically, the passage portion 73 passes through the water drain hole 2*b* provided in the wall plate 2*a* of the housing 2 and extends toward outside the housing 2. The grounding connection member 70 is further provided with a resilient tongue piece portion 74 and a contact portion 75.

Since the example of FIG. 6 has substantially the same structure as the grounding connection member in the extendable antenna 10 shown in FIG. 1, except for the grounding connection member 70, the members having the same functions as those in FIG. 1 are denoted by the same reference numerals and detailed explanation thereof is omitted.

With the aforementioned structure, the rain water flowing from the antenna guide 30 into the grounding connection member 70 is discharged through the cylindrical passage portion 73 without touching the housing 2. As a result, in addition to the similar effect to the extendable antenna 10 of FIG. 1, leakage of the rain water between the grounding connection member 70 and the housing 2 can be reliably avoided.

Figure 7:
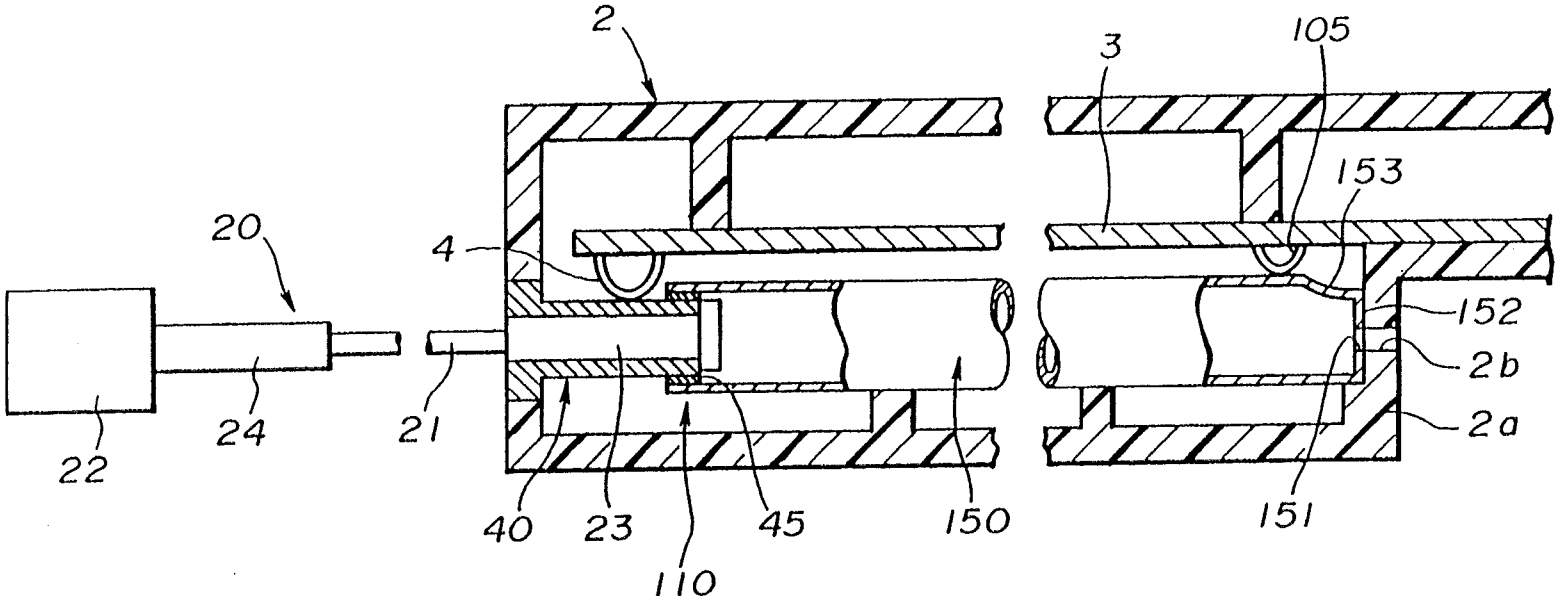
FIG. 7 is a side cross-sectional view of a major part of an extendable antenna in accordance with yet a further embodiment of the present invention.

In an extendable antenna 110 shown in FIG. 7, an antenna guide is integrally formed with a grounding connection member to form a single integral part.

More in detail, the extendable antenna 110 comprises an elongated grounding connection member 150 which is extended from the power supply connection member 40 fixed to the housing 2 along a length of movement in the first contact portion 23 of the antenna member 20. The grounding connection member 150 fittingly receives at its one end (left-end in the drawing) the power supply connection member 40 with a collar 45 of an insulating-material disposed therebetween. Meanwhile, the grounding connection member 150 is provided at the other end (right-end in the drawing) with a bottom plate 152 having a bottom hole 151 and also with an inwardly projected contact portion 153.

The power supply connection member 40 is connected to the communication circuit (not shown) through the terminal 4 provided on the circuit board 3, whereas the grounding connection member 150 is connected to the grounded portion (not shown) of the radio transceiver through a terminal 105 provided on the circuit board 3.

The major part of the grounding connection member 150, except for its one end (right-end) having the contact portion 153, functions as an antenna guide. When the rod antenna portion 21 of the antenna member 20 is retracted in the interior of the housing 2, the first contact portion 23 is moved as guided by the grounding connection member 150 and eventually abuts against the contact portion 153.

Further, when the rod antenna portion 21 with rain water attached is retracted into the interior of the housing 2, the rain water is led along the interior of the grounding connection member 150 to the bottom plate 152 and then discharged to the outside from the bottom hole 151 in the bottom plate 152 through the water drain hole **2*b* provided in the wall plate 2*a* of the housing 2, whereby intrusion of the rain water into the communication circuit located within the housing 2** can be avoided.

With the aforementioned structure, further, since not only the similar effect to the extendable antenna 10 shown in FIG. 1 is provided but also the function of the antenna guide is provided to the grounding connection member 150, the need for provision of the antenna guide 30 in the extendable antenna 10 of FIG. 1 can be eliminated and therefore the number of necessary parts in the radio transceiver can be reduced. In addition, since the grounding connection member 150 is extended along the movement direction of the antenna member 20 so that the set position of the terminal 105 for interconnection between the grounded portion of the radio transceiver and the grounding connection member of the antenna can be suitably set and thus the circuit design flexibility can be improved.

Figure 8:
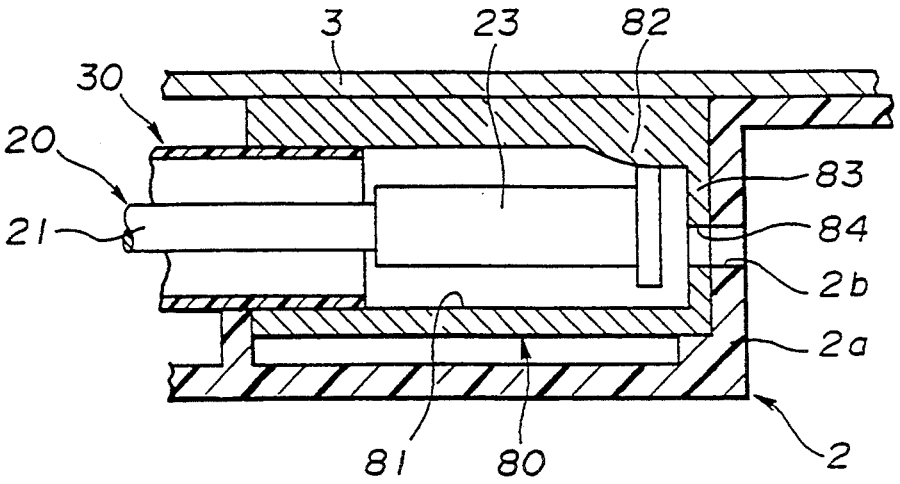
FIG. 8 is a side cross-sectional view of a major part of an extendable antenna in accordance with another embodiment of the present invention.

A grounding connection member 80 shown in FIG. 8 is formed of a block of electrically conductive material having a retracting portion 81 into which the first contact portion 23 is retracted. The grounding connection member 80, which is fixedly mounted on the circuit board 3 disposed within the housing 2, fittingly receives one end of the antenna guide 30. The grounding connection member 80 is also connected to the grounded portion (not shown) of the radio transceiver.

The grounding connection member 80 has a contact portion 82 at its deeper end (rightward in the drawing) inwardly projecting from the inner wall of the grounding connection member 80 to be contacted with the first contact portion 23 of the antenna member 20. The grounding connection member 80 has an end wall (bottom plate) 83 having a bottom hole 84 extending along the axial line of the antenna member 20 to communicate with the water drain hole **2*b* of the wall plate 2*a* of the housing 2**.

With the grounding connection member 80 having the aforementioned structure, since the terminal 5 in the extendable antenna 10 shown in FIG. 1, i.e., the terminal for connection of the grounding connection member to ground becomes unnecessary, the number of necessary parts in the radio transceiver can be reduced in addition to the similar effect to the extendable antenna 10 of FIG. 1. In addition, since the grounding connection member 80 is fixed to the circuit board 3, workability in manufacturing of the radio transceiver can be improved.

Figure 9:
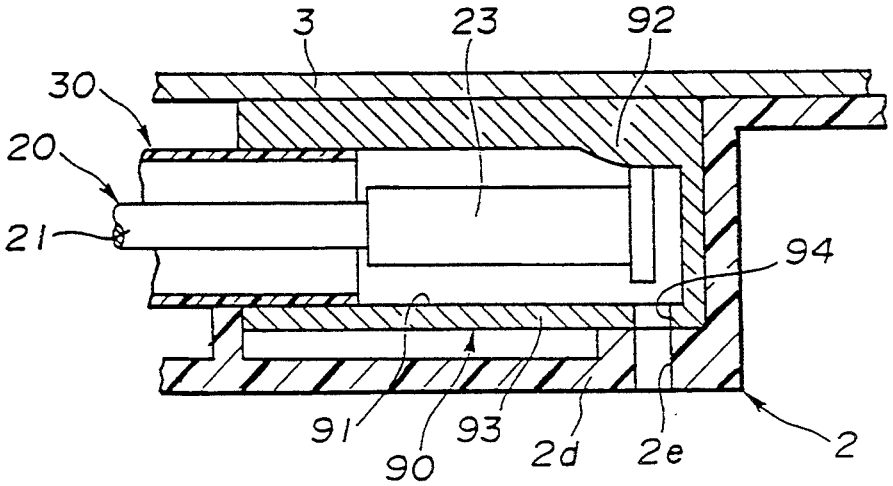
FIG. 9 is a side cross-sectional view of a major part of an extendable antenna in accordance with still another embodiment of the present invention.
Figure 10A:
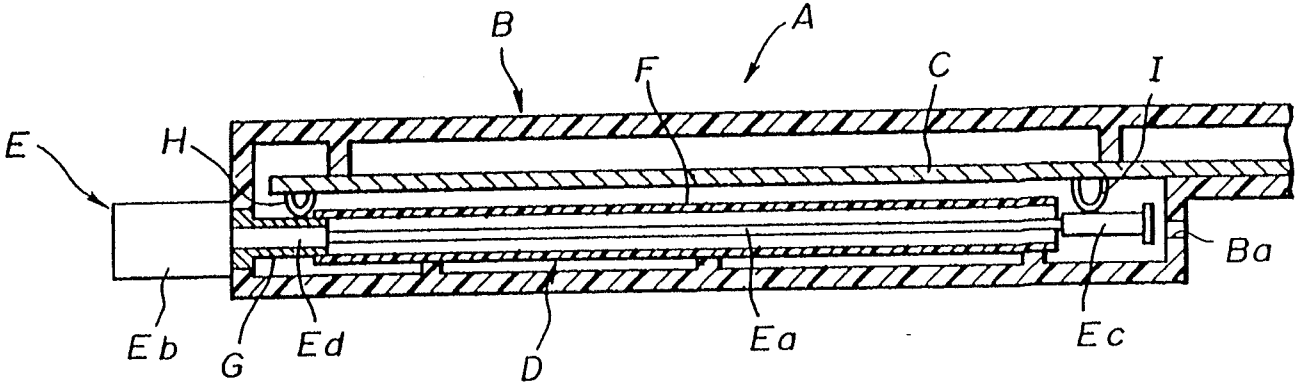
FIG.10(a)(PRIOR ART)
FIGS. 10(*a*) and 10(*b*) show side cross-sectional views of major parts of a prior art extendable antenna and a radio transceiver.
Figure 10B:
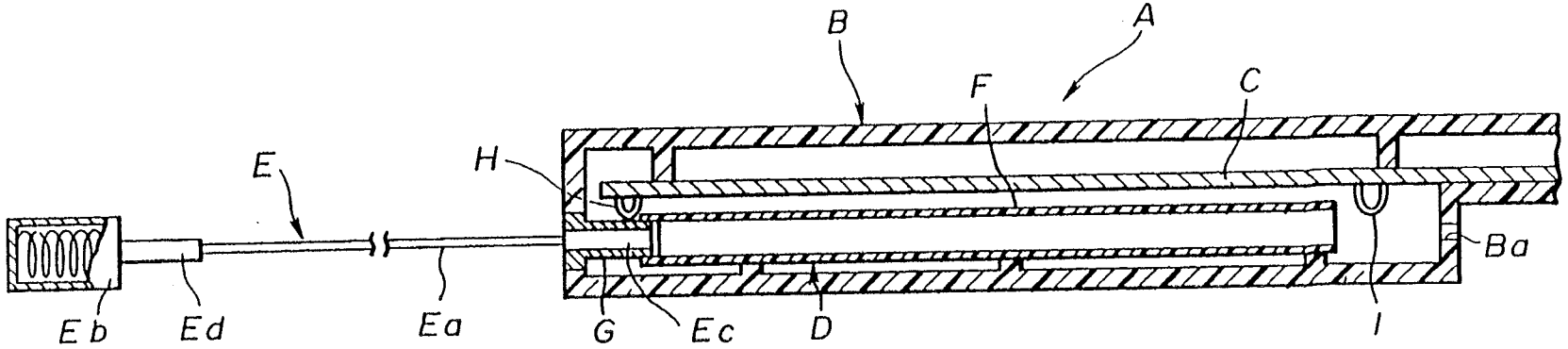
FIG.10(b)(PRIOR ART)

A grounding connection member 90 shown in FIG. 9 is, like the grounding connection member 80 of FIG. 8, formed of a block of electrically conductive material having a retracting portion 91 which fittingly receives one end of the antenna guide 30. The grounding connection member 90 is fixedly mounted on the circuit board 3 disposed within the housing 2 and is also connected to the grounded portion (not shown) of the radio transceiver. The grounding connection member 90 has a contact portion 92 at its deeper end (rightward in the drawing) inwardly projecting from the inner wall of the grounding connection member 90.

Meanwhile, the housing 2 has a wall plate **2*d* which is positioned at the lower side of the drawing and which is formed therein with a water drain hole 2*e*. The grounding connection member 90 has a peripheral wall 93 which is formed with a hole 94. The hole 94 extends in a direction intersecting the axial line of the antenna member 20 so as to communicate with the water drain hole 2*e***.

Even in the case of using the grounding connection member 90 having the aforementioned structure, as in the grounding connection member 80 of FIG. 8, not only the grounding connection member 90 has the similar effect to the extendable antenna 10 of FIG. 1 but also the number of necessary parts in the radio transceiver can be reduced, whereby the workability in manufacturing of the radio transceiver can be enhanced.

Further, the grounding connection members shown in FIGS. 8 and 9 may employ such a structure of disposing the packing between the housing and the grounding connection member as shown in FIG. 5 or such a structure of forming the cylindrical passage portion passing through the water drain hole of the housing as shown in FIG. 6. In addition, the grounding connection member of FIGS. 8 and 9 may be arranged so as to have such an antenna guide function as shown in FIG. 7.

What is claimed is:

1. An extendable antenna for a radio transceiver enclosed in a housing, comprising:

a first antenna having a first conductive connection portion;

a second antenna connected with the first antenna at an end of the first antenna;

a cylindrical antenna guide provided within the housing for guiding the first antenna into the housing when the first antenna is retracted; and cylindrical grounding connection means, extending from an end of the antenna guide and being connected to a grounded portion of the radio transceiver, for providing a connection to ground and for channeling water in the antenna guide to a water drain hole provided in the housing, wherein when the first antenna is retracted into the housing the first conductive connection portion is brought into contact with the grounding connection means.

2. The extendable antenna as set forth in claim 1, wherein the grounding connection means has a bottom plate, which contacts the housing and which is provided with a hole communicating with the water drain hole.

3. The extendable antenna as set forth in claim 1, further including a packing, which has a through hole communicating with a hole formed in a bottom plate of the grounding connection means and also communicating with the water drain hole of the housing.

4. The extendable antenna as set forth in claim 2, wherein the grounding connection means has a cylindrical passage portion communicating with the hole formed in the bottom plate of the grounding connection means and passing through the water drain hole so as to extend to outside the housing.

5. The extendable antenna as set forth in claim 1, wherein the grounding connection means has a resilient tongue portion contacting the housing, the grounding connection means being disposed between a wall of the housing having the water drain hole and a rib facing the wall so as to contact the wall of the housing.

6. An extendable antenna for a radio transceiver enclosed in a housing, comprising:

first antenna means having a first conductive connection portion;

second antenna means connected with the first antenna at an end of the first antenna means;

cylindrical antenna guide means provided within the housing for retracting the first antenna means; and cylindrical grounding connection means provided at an end of the antenna guide means and connected to a grounded portion of the radio transceiver, the grounding connection means facing a water drain hole provided in the housing, wherein, when the first antenna means is retracted into the housing, the first conductive connection portion is brought into contact with the grounding connection means, and wherein the grounding connection means has a contact portion which is brought into contact with the first conductive connection portion when the first antenna means is retracted into the housing, the contact portion being projected inwardly from an inner peripheral surface of the grounding connection means.

7. The extendable antenna as set forth in claim 1, wherein the grounding connection means is mounted to a circuit board disposed within the housing.

8. The extendable antenna as set forth in claim 7, wherein the grounding connection means comprises a block of electrically conductive material which is provided with a portion in which at least a portion of the first antenna is retracted, the grounding connection means having a hole at a bottom portion thereof.

9. The extendable antenna as set forth in claim 8, wherein the grounding connection means has an end wall and the hole is provided at the end wall and extends along an axial line of the antenna.

10. The extendable antenna as set forth in claim 8, wherein the grounding connection means has a peripheral wall and the hole is provided at the peripheral wall and extends in a direction intersecting an axial line of the antenna.

11. The extendable antenna as set forth in claim 1, wherein the grounding connection means is integrally formed with one end of the antenna guide.

12. An extendable antenna for a radio transceiver enclosed in a housing, comprising:

a first antenna having a first conductive connection portion at an end;

a second antenna having a loading coil and a second conductive connecting portion provided at an end of the loading coil, the second antenna being connected with the first antenna at the other end of the first antenna;

a cylindrical antenna guide provided within the housing for guiding the first antenna into the housing when the first antenna is retracted; and cylindrical grounding connection means, extending from an end of the antenna guide and being connected to a grounded portion of the radio transceiver, for providing a connection to ground and for channeling water in the antenna guide to a water drain hole provided in the housing, wherein when the first antenna is retracted into the housing the first conductive connection portion is brought into contact with the grounding connection means.

13. A radio transceiver enclosed in a housing, comprising:

a circuit; and an extendable antenna comprising:

a first antenna having a first conductive connection portion at an end;

a second antenna having a loading coil and a second conductive connection portion at an end of the loading coil, the second antenna being connected with the first antenna at the other end of the first antenna;

a cylindrical antenna guide provided within the housing for guiding the first antenna into the housing when the first antenna is retracted; and a cylindrical grounding connector extending from an end of the antenna guide and being connected to a grounded portion of the radio transceiver, wherein when the first antenna is retracted into the housing the first conductive connection portion is brought into contact with the grounding connector.

14. An extendable antenna for a radio transceiver enclosed in a housing, the radio transceiver having a feeding portion electrically connected with a circuitry of the radio transceiver, the extendable antenna comprising:

a first antenna having a first conductive connection portion at an end;

a second antenna having a loading coil and a second conductive connecting portion provided at an end of the loading coil, the second antenna being connected with the first antenna at the other end of the first antenna;

a cylindrical antenna guide provided within the housing for guiding the first antenna into the housing when the first antenna is retracted; and cylindrical grounding connection means, extending from an end of the antenna guide and being connected to a grounded portion of the radio transceiver, a water drain hole provided in the housing, the grounding connection means being in contact with the housing, wherein when the first antenna is extended from the housing, the first conductive connection portion is brought into contact with the feeding portion, and when the first antenna is retracted into the housing, the second conductive connection portion is brought into contact with the feeding portion and the first conductive connection portion is brought into contact with the grounding connection means.

15. A radio transceiver enclosed in a housing, comprising:

a circuit; and an extendable antenna comprising:

a first antenna having a first conductive connection portion;

a second antenna connected with the first antenna at an end of the first antenna;

a cylindrical antenna guide provided within the housing for guiding the first antenna into the housing when the first antenna is retracted; and cylindrical grounding means, extending from an end of the antenna guide and being connected to a grounded portion of the radio transceiver, for providing a connection to ground and for channeling water in the antenna guide to a water drain hole provided in the housing, wherein when the first antenna is retracted into the housing the first conductive connection portion is brought into contact with the grounding means.

16. An extendable antenna for a radio transceiver enclosed in a housing, comprising:

a first antenna having a conductive connection portion;

a second antenna;

a cylindrical antenna guide provided within the housing for guiding the first antenna into the housing when the first antenna is retracted; and cylindrical grounding means, extending from an end of the antenna guide and being connected to a grounded portion of the radio transceiver, for providing a connection to ground and for channeling water in the antenna guide to a water drain hole provided in the housing, wherein when the first antenna is retracted into the housing the conductive connection portion is brought into contact with the grounding means.

17. A radio transceiver enclosed in a housing, comprising:

a circuit; and an extendable antenna comprising:

a first antenna having a conductive connection portion;

a second antenna;

a cylindrical antenna guide provided within the housing for guiding the first antenna into the housing when the first antenna is retracted; and cylindrical grounding means, extending from an end of the antenna guide and being connected to a grounded portion of the radio transceiver, for providing a connection to ground and for channeling water in the antenna guide to a water drain hole provided in the housing, wherein when the first antenna is retracted into the housing the conductive connection portion is brought into contact with the grounding means.

* * * * *